US006398136B1

(12) United States Patent
Smith

(10) Patent No.: US 6,398,136 B1
(45) Date of Patent: Jun. 4, 2002

(54) PENETRATING AND MISTING FIRE-FIGHTING TOOL WITH REMOVABLY ATTACHABLE WANDS AND NOZZLES

(76) Inventor: Edward V. Smith, 19305 SW. Anderson, Aloha, OR (US) 97007

( * ) Notice: Subject to any disclaimer, the term of this patent is extended or adjusted under 35 U.S.C. 154(b) by 0 days.

(21) Appl. No.: 09/375,301

(22) Filed: Aug. 16, 1999

(51) Int. Cl.[7] ..... B05B 1/00

(52) U.S. Cl. ..... 239/600; 239/271; 239/397; 239/436; 239/530; 239/543; 239/544; 239/556; 239/559; 239/567; 239/589; 169/70; 285/86; 285/361; 285/376; 285/401

(58) Field of Search ..... 239/271, 375, 239/390–391, 397, 436, 442, 525, 530, 532, 544, 556–559, 600, 567, 550, 589, 397.5, 543, 545; 169/48, 51, 52, 70, 68, 54, 15, 46, 47; 285/85–86, 360, 361, 376, 396, 401, 402; 138/145, 146, 177, 178

(56) References Cited

U.S. PATENT DOCUMENTS

| | | | | | |
|---|---|---|---|---|---|
| 2,224,010 | A | * | 12/1940 | Barber | 169/70 |
| 2,235,258 | A | * | 3/1941 | Jones | 239/543 |
| 2,619,385 | A | * | 11/1952 | Simms | 239/375 |
| 2,993,650 | A | * | 7/1961 | Badberg | |
| 4,358,058 | A | | 11/1982 | Bierman | 239/447 |
| 4,485,877 | A | * | 12/1984 | McMillan et al. | 169/48 |
| 4,568,025 | A | | 2/1986 | McLoud | 239/467 |
| 4,697,740 | A | | 10/1987 | Ivy | 239/271 |
| 4,700,894 | A | | 10/1987 | Grzych | 239/555 |
| 5,062,486 | A | | 11/1991 | McClenahan | 169/70 |
| D339,846 | S | | 9/1993 | Magee | D23/213 |
| 5,253,716 | A | * | 10/1993 | Mitchell | 169/70 |
| 5,261,494 | A | | 11/1993 | McLoughlin et al. | 169/70 |
| 5,277,256 | A | | 1/1994 | Bailey | 169/15 |
| D351,642 | S | | 10/1994 | Mitchell | D23/213 |
| 5,447,203 | A | | 9/1995 | McLoughlin et al. | 169/70 |
| 5,590,719 | A | | 1/1997 | McLaughlin et al. | 169/70 |
| 5,678,766 | A | | 10/1997 | Peck et al. | 239/419 |
| 5,810,089 | A | * | 9/1998 | Mack | 169/15 |

* cited by examiner

*Primary Examiner*—William C. Doerrler
*Assistant Examiner*—Christopher S. Kim
(74) *Attorney, Agent, or Firm*—William S. Lovell; S. Rose Jade

(57) ABSTRACT

A fire-fighting tool incorporates a twist-lock mechanism whereby various nozzles can be interchanged for particular fire-fighting purposes. Included in such nozzles are a penetrating nozzle having a doubly bevelled front end for easier access through a roof, and various fluid ejection and misting elements that can be configured in terms of fluid aperture angles to produce a mist directed somewhat back towards the user, transverse to the nozzle, or forward from the nozzle. A non-penetrating embodiment of the invention also uses an end ejecting misting region. The foregoing elements can be used in conjunction with various extention wands, which are removably connectable fluid channels bent to various angles, so as to provide easier access to fires that are located within recesses of buildings, motor vehicles, or boats and the like.

6 Claims, 8 Drawing Sheets

Fig. 19
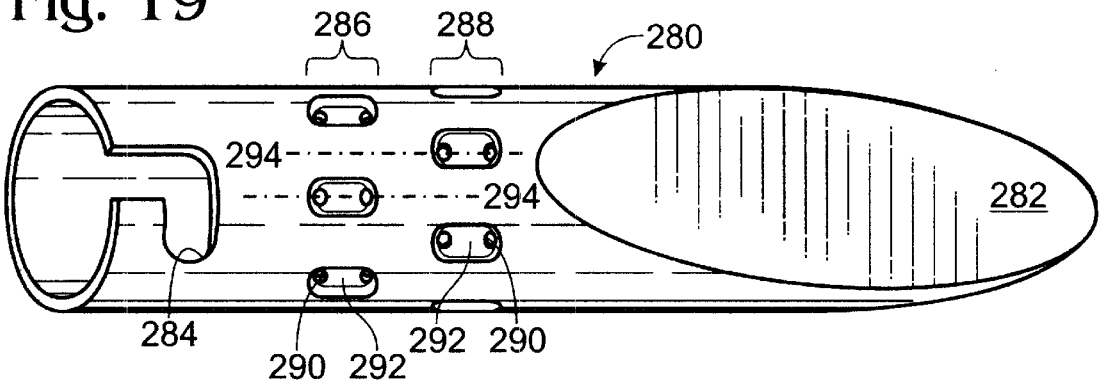
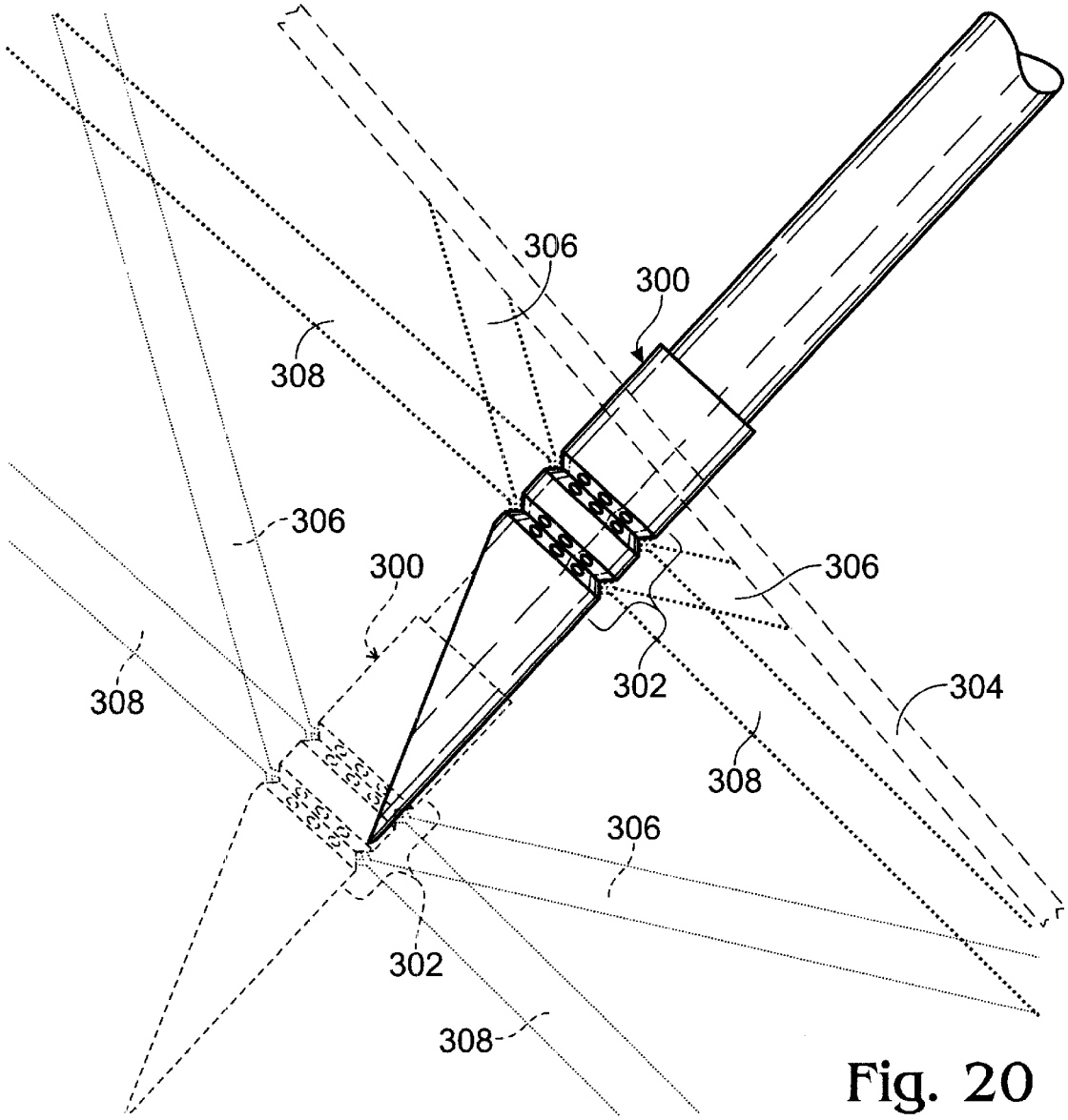
Fig. 20

PENETRATING AND MISTING FIRE-FIGHTING TOOL WITH REMOVABLY ATTACHABLE WANDS AND NOZZLES

BACKGROUND OF THE INVENTION

1. Field of the Invention

This invention relates to fire fighting equipment, and particularly to water nozzles adapted to pierce through a roof and provide a water spray to extinguish a fire, and to alternative, exchangeable embodiments that may pierce into other structures.

2. Background Information

Effective fire control and extinguishment requires basic understanding of chemical and physical nature of fire. Combustion is the rapid oxidation of fuel along with the evolution of heat and light. The "fire triangle" includes oxygen, heat and fuel; fire needs approximately 16% oxygen to free burn.

In its starting or "incipient phase," fire may produce flame temperatures of 1000 degrees Fahrenheit, yet the room temperature is only slightly increased. Water vapor, carbon dioxide and small quantity of sulfur dioxide and carbon monoxide are present.

The second phase of fire is referred to as free burning; this encompasses all free burning activities of the fire. Oxygen rich air is drawn into the fire and convection heat carries gases into the uppermost regions of the room. The heated gases then spread out laterally from the upper most surfaces forcing the cooler air downward. Along its path fire is consuming all combustible materials and temperatures of approximately 1300 degrees Fahrenheit are consuming oxygen and will continue to burn until there is insufficient oxygen to react with the fuel load.

The third phase of fire, referred to as smoldering, occurs when the burning is reduced to glowing embers. If the room is sufficiently airtight and the oxygen has been reduced, temperatures will rise and smoke will fill the room along with increased hydrogen and methane gas which leads to the possibility of backdraft (a new entry of oxygen).

Early theories of fire fighting, often held even now by lay persons, were that the fire was to be "drowned," i.e., deprived of oxygen. The continuing development of the art, however, along with the contributions of physics and chemistry, have shown that the principal effect of applying fluids such as water to a fire lie in reducing the temperature below that at which burning will occur. That must occur, of course, by the transfer of heat energy from the burning materials to the water.

The processes by which water or similar such fire-fighting materials absorb heat are actually three in number: firstly, the water is heated up from its "hose temperature" to the boiling point; secondly, that heated water is vaporized into water vapor; and thirdly that water vapor is itself heated further, so long as the temperature of the fire remains above about 212 degrees Fahrenheit, the boiling point of water. It is the second one of those steps that is most effective in absorbing heat from a fire, as can be seen from a comparison of the number of calories or BTUs of heat required to accomplish each step.

Thus, the specific heat of water, by which is meant the amount of heat that is required to raise the temperature of a gram of water one degree Centigrade is approximately 1 calorie. The latent heat of vaporization of water, however, is 540 calories per gram. Since one BTU is equivalent to 252 calories, one gram of water can remove somewhat more than 2 BTU of heat from a fire by its vaporization alone. In more familiar firefighting terms, since a gallon of water weighs roughly 3.8 kilograms, vaporization of a gallon of water absorbs about 7,600 BTUs of heat.

The subsequent heating of the resultant water vapor is not inconsequential, given that the burning materials and hot gases may be 1000 degrees or so above room temperature, the object being, of course, that upon heating the water vapor the other materials will cool down below their ignition temperature and the fire will be extinguished. However, it is the initial vaporization of the incident water that makes the heating of the resultant water vapor possible, hence efficient water vaporization turns out to be the key step in effective fire-fighting.

The so-called "expansion" of an amount of water into vapor is often referred to as being effective in "smothering" a fire because that water vapor occupies space that might otherwise be occupied by oxygen. That idea, however, neglects the fact that even though the theoretical volume of an amount of water in the vapor state is about 1700 times that in its liquid state, one still has precisely the same amount of water, every molecule of water takes up roughly the same volume as it did in its liquid state, and since that water vapor now constitutes a gas, that theoretical volume consists primarily of empty space if the water vapor were there alone, or space that in the context of a fire will be filled with other gases, including both oxygen and the hot gases of the fire, such as the fire byproducts carbon monoxide and carbon dioxide. The effect of the dispersal of an amount of water into vapor derives not from any volume change, therefore, but rather because the wide dispersal of the water vapor puts it into intimate contact with the gases that are to be cooled off, and the same will of course be true of a mist of visible water droplets (which near the boiling point constitutes steam), and those droplets may then be vaporized into invisible water vapor to provide the most effective step in fire fighting.

Firefighters responding to a confined fire that is in either the free-burning or smoldering phases risk the occurrence of backdraft by ventilating the structure. The fire is incomplete because it has used up all available oxygen, yet heat has remained in the structure. Improper ventilation will increase oxygen which will then explode upon reaching the stalled combustion process. The proper use of the piercing nozzle and attachments will avoid opening up a new source of oxygen to remove one side of the fire triangle oxygen, and then by cooling the fire can be removed from its existing, dangerous state to one of extinguishment.

With respect to the cooling effects of mist, a test was conducted on one version of the mist-producing, penetrating nozzle to be described hereinafter, with reference to a standard fire nozzle that ejects liquid water. In a test building, fires were initiated in rooms of comparable size so as to become totally involved. Using a standard fire nozzle, the first of such fires was extinguished in 2 minutes using 250 gallons of water. The second fire was extinguished using the misting nozzle in 5 seconds using 15 gallons of water.

Generally representative of prior art penetrating nozzles is the "FAAAST" tool 10 manufactured and sold by Advanced Manufacturing Technologies, Inc. of Grafton, Wis. and shown in FIG. 1. Tool 10 generally comprises an elongate cylindrical and fluid-carrying shaft 12, at a first end of which is disposed a fluid discharge region 14 and distally therefrom a penetrating member 16. At a second end of shaft 12 is disposed firstly a nozzle connector 18 to which is attached a fluid-bearing fire hose (not shown), and secondly a guide shaft 20 for effecting orientation of tool 10 relative to a roof or like structure to be penetrated. Included on guide shaft 20 is a slide hammer 22 that can be used to assist in forcing the penetrating member 16 through a roof or the like. Particular nozzle tip designs can be seen in U.S. Des. 339,846 issued Sep. 28, 1993 to Magee and U.S. Des. 351,642 issued Oct. 18, 1994 to Mitchell.

Beyond such design considerations, some particular functional aspects of nozzle construction have been set out in U.S. Pat. No. 4,358,058 issued is Nov. 9, 1982 to Bierman, U.S. Pat. No. 4,700,894 issued Oct. 20, 1987 to Grzych, and U.S. Pat. No. 4,568,025 issued Feb. 4, 1986 to McLoud. The Bierman device includes a rotating section and control handle whereby an operator can select among modes of operation involving a whirling wide angle cone of fog, a forward narrow angle cone of fog, a solid stream, or shutoff. The Grzych device provides an essentially spherical stream of fog so as to encompass the entire interior of a room, thus also eliminating reactive forces that can give rise to whipping. The McLoud device provides a downwardly directed cone of spray over a developed fire. Although the Bierman, Grzych and McLoud devices each permit extension of their respective nozzles into a room while the operator remains outside, none provides means for piercing or penetrating into such a room using the nozzle itself.

Additional variations in nozzle design include U.S. Pat. No. 5,261,494 and 5,447,203, respectively issued Nov. 16, 1993, and Sep. 5, 1995, to McLoughlin et al., which provide means for independent control of both a solid stream of water for "punching" into a fire and a fog-generating mode for cooling a larger region of a fire, provision also being made for remote control operation, a later version in U.S. Pat. No. 5,590,719 issued Jan. 7, 1997 to McLaughlin et al. that includes a foam injection system, and U.S. Pat. No. 5,277,256 issued Jan. 11, 1994 to Bailey that provides for switching between the dispensing of water in the usual manner, or of two other firefighting agents. Similarly, U.S. Pat. No. 5,678,766 issued Oct. 21, 1997 to Peck et al. provides for discharging a foam and water mixture. However, these are again not penetrating or piercing nozzles.

One rather unique such device that is particularly adapted to fighting fires that have developed within the "insulation space" of a wall is described in U.S. Pat. No. 4,485,877 issued Dec. 4, 1984 to McMillan et al. This device includes a penetration member that is relatively smaller than and mounted transversely to the main fluid conduit, provision being made for diversion of fluid into that penetration member so as to be discharged within a wall into which the penetration member has been forced. An additional safety feature is that when the device is used instead in its usual "attack" mode employing the main fluid conduit, the spraying feature of the penetration means can be activated as well so as to provide a protective ball of mist in the vicinity of the operator. By contrast, and similar to the device of FIG. 1, however, in most cases the piercing or penetrating feature of fire nozzles has been incorporated within the main fluid dispensing nozzle.

As to such specifically penetrating nozzles, U.S. Pat. No. 4,697,740 issued Oct. 6, 1987 to Ivy describes a device similar to that shown in FIG. 1 except that instead of using a slide hammer to assist in forcing the nozzle through a roof or similar obstacle, the end of the fluid conduit opposite the nozzle terminates in a strike plate that may be directly hammered upon so as to force penetration. The channel through which the fluid to be dispensed arrives at that fluid conduit is then connected into the side of that conduit, at an angle so as to trail off away from the nozzle end. A patent that shows the slide hammer of FIG. 1 is found in U.S. Pat. No. 5,062,486 issued Nov. 5, 1991 to McClenahan, but which is distinguished from both the device of FIG. 1 and the Ivy device by having a penetrating member that is symmetrical about a central axis, while the penetrating members of FIG. 1 and of Ivy have an elliptically bevelled structure, yielding a sharp and curved edge to facilitate penetration.

Another feature of the Ivy device, also found in a different form in U.S. Pat. No. 5,253,716 issued Oct. 19, 1993 to Mitchell, involves the use of orifices for the discharge of water or other fire suppression agents that breaks the agent into small droplets or "mist" for more effective fire suppression, i.e., water configured into droplets rather than as a solid stream presents a much larger surface area for absorption of heat from the fire, those droplets convert to steam thus absorbing even more heat, and both the droplets and steam encompasses a larger volume to assist in excluding oxygen. The mechanism for so doing in Ivy comprises an internal cylinder including elongate slots, and externally adjacent to that cylinder a sleeve bearing a plurality of small apertures. Ejection of water through such apertures causes the sleeve to rotate, thereby momentarily exposing those apertures to the adjacent slots so as to discharge the fluid outwardly therefrom in a spiral pattern of droplets. The piercing member is connected by matching threads to the main fluid-bearing shaft.

In the Mitchell device, which incorporates a tetrahedral (or "bayonet") rather than a bevelled penetration member, a mist is formed by the use of pairs of small fluid discharge apertures set at relative angles of ninety degrees which causes collision between emerging streams of such agents thereby breaking those streams into droplets. The Mitchell device also has a modular construction to permit being carried in segments that can be locked together at the time of use, wherein the total resultant length of the device can be selected so as to be convenient within the space available at a particular fire scene.

The aforesaid devices exploit generally the processes of penetrating building structures so as to bring to bear therein a fire extinguishing medium, and secondly of providing that medium (typically water) in a misted or fogged form so as to extinguish a fire more efficiently. Improvement of such devices with respect both to the patterns of mist or fog that are to be generated and the structures that may be penetrated are then the subject matter of the present invention, particularly with respect to providing the ability to accommodate a variety of fire-fighting situations using a single tool. What is needed and would be useful, therefore, are added means for protection of the fire-fighter, easier penetration of the structure to be treated, and flexibility both as to convenient, on-site adaptation of the tool to the nature of the structure within which a fire is to be extinguished, including automobiles and boats and the like, and some means for adapting the fluid pattern to be applied to the nature and disposition of the fire within some particular type of structure, as will be hereinafter shown and described.

SUMMARY OF THE INVENTION

The invention is a fire-fighting tool incorporating a ceramic thermal barrier for user safety, a non-slip grip and doubly bevelled penetration member for ease of use, an array of interchangeable nozzle wands for use in a variety of fire-fighting situations, and improved mist-producing means whereby the mist can be formed in pre-determined patterns and be directed at pre-determined angles from the tool so as better to attack the specific location and type of fire within various structures.

BRIEF DESCRIPTION OF THE DRAWINGS

The preferred embodiments of the invention will now be described in detail with reference the accompanying drawings, in which:

FIG. 19 is an oblique view of an embodiment of the nozzle comprising the invention wherein adjacent rows of orifice pairs contained within pits are offset one from the other.

FIG. 20 is a formal drawing, not intended to depict precise angles or mist patterns, that illustrates an advantageous application of an embodiment of the invention wherein the mist pattern is directed somewhat backward towards the operator as the nozzle is made to pierce through a roof.

DETAILED DESCRIPTION OF THE INVENTION

Figure 1:
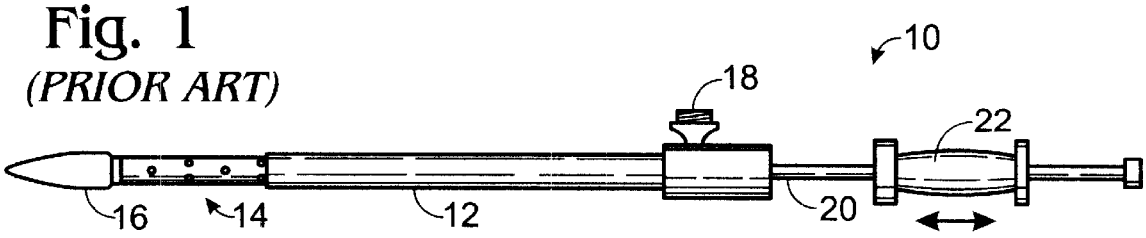
Fig. 1 (PRIOR ART)
FIG. 1 shows from the prior art an exemplary, commercially available fire-fighting fighting tool having a penetrating nozzle.
Figure 2:
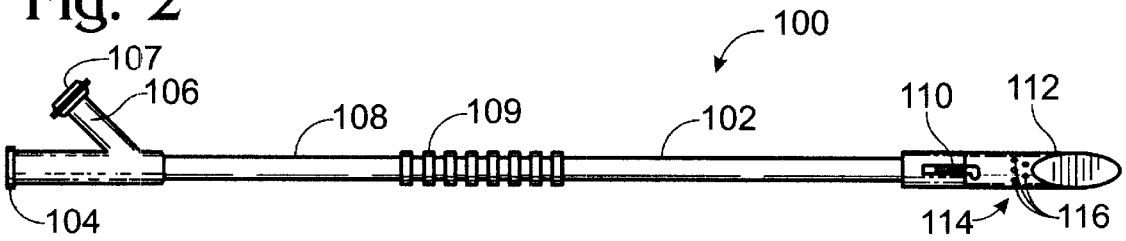
FIG. 2 show a side elevation view of a preferred embodiment of the fire-fighting fighting tool comprising the invention, including a penetrating nozzle.

A first preferred embodiment of the invention is shown as fire tool 100 in FIG. 2, and has as its principal component an elongate cylindrical tube 102 for conducting fire-fighting fluid such as water therethrough. A first end of tube 102 has disposed thereon a strike plate 104, adapted and strengthened to be used as a location at which hammer blows may be delivered so as to force the opposite end of tube 102 through a roof or wall or the like and thereby permit application of fire-fighting fluid passing therethrough to a fire on the opposite side of such a roof or wall. Near that end of tube 102 at which strike plate 104 is disposed there is further provided a fluid inlet 106, to which would typically be removably connected through a hose connector 107 to a conventional fire hose (not shown).

Fire tool 100 further comprises ceramic coating 108 disposed principally onto the surface of tube 102 near to fluid inlet 106, that being the end of tube 102 that will primarily be handled by the user of fire tool 100, coating 108 thus acting as a thermal barrier against heat transmitted back from a fire through tube 102, which may typically be formed of highly heat conductive alloy or stainless steel, when the opposite end of tube 102 is put near to a fire. Grip 109, which is a plurality of mutually parallel toroidal extensions from tube 102, serves to provide a "non-slip" grip to enable a user to apply a thrusting force to fire tool 100 thus enabling easier penetration thereof through a roof or the like.

Fixedly disposed at that opposite end of tube 102 is a quick release twist lock 110 to which, as will be more fully described hereinafter, is to be removably attached a penetrating nozzle 112 having disposed therein fluid outlet 114 which essentially comprises a pattern of orifices 116 through which a fire fighting fluid such as water that enters tube 102 through fluid inlet 106, then passes through tube 102 and then twist lock 110, becomes ejected into the vicinity of a fire as a fine mist.

Figure 3:
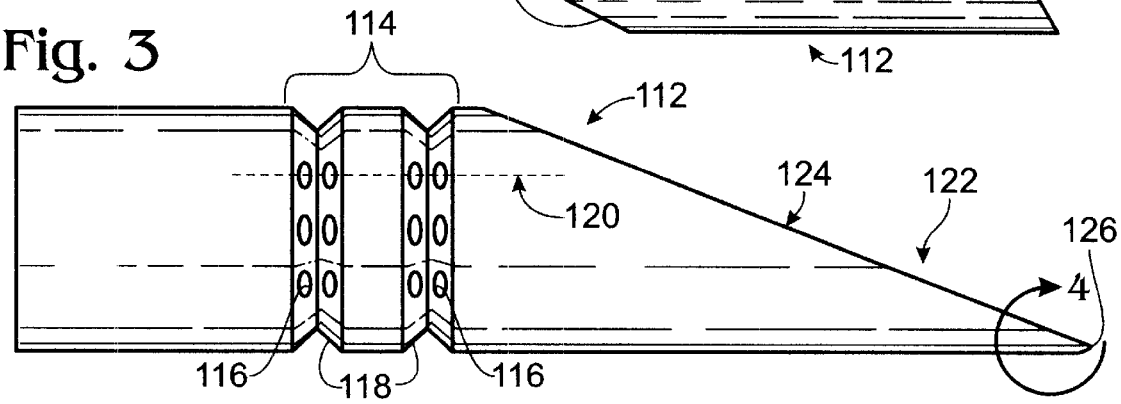
FIG. 3 shows an enlarged top plan view of the penetrating nozzle included within FIG. 2.

FIG. 3 shows an enlarged top plan view (which aspect of fire tool 100 is the "top" being of course quite arbitrary) of penetrating nozzle 112, wherein additional detail with regard to fluid outlet 114 and orifices 116 can be seen. Specifically, fluid outlet 114 further comprises (in this embodiment of the invention) a pair of mutually parallel toroidal, essentially "V-cut" grooves 118 extending entirely around the circumference of nozzle 112. Pairs of orifices 116 are disposed along a common imaginary line 120 extending longitudinally along nozzle 112, both as to the individual orifices 116 disposed on facing sides of V-cut grooves 118 and to respective pairs of orifices 116 disposed within respective parallel grooves 118. As shown in part in FIG. 3, a plurality of such pairs of orifices 116 is distributed in an essentially equidistant manner around the circumferences of grooves 118 in a fully symmetric manner. As a consequence, reaction forces brought about by the discharge of a fire-fighting medium such as water from orifices 116 will be balanced about the entirety of nozzle 112, hence such discharge will impart no lateral impetus to nozzle 112.

Figure 4:
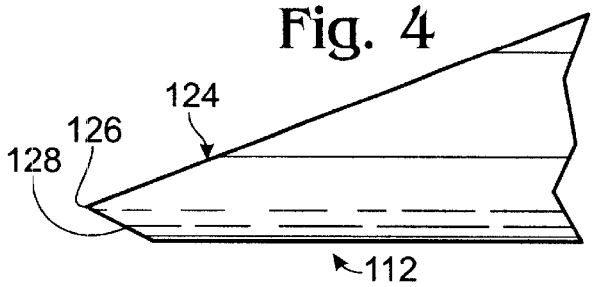
FIG. 4 shows a further enlargement of the tip of the penetrating nozzle of FIG. 3 showing a double bevel.

The distal end 122 of nozzle 112 is seen in FIG. 3 to comprise an elongate first bevel 124 that cuts slant-wise across the full lateral dimension of nozzle 112 to as to produce a cutting edge 126 suitable for easier penetration of a roof or the like. Such a bevel structure, employed also in the Ivy device, tends to concentrate the penetration force of the nozzle in one direction, rather than in four directions as in the Mitchell device. It has also been found advantageous in the present invention to incorporate a shorter second bevel 128 near to the ultimate distal end 122 of nozzle 112 that encompasses only part of the lateral dimension of the remaining portion of nozzle 112, as shown in FIG. 4, which is a further enlarged view of distal end 122 of nozzle 112, and that provides a more rigid cutting edge 126.

Figure 5:
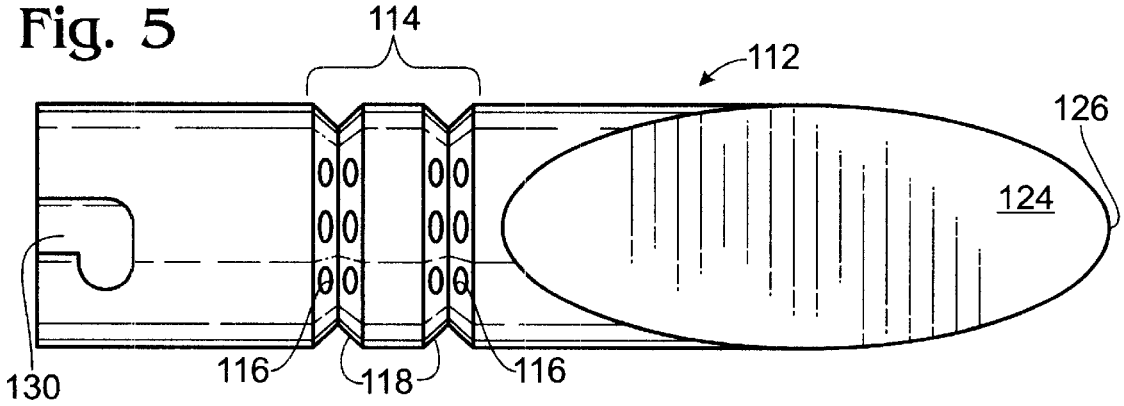
FIG. 5 shows an enlarged side elevation view of the penetrating nozzle included within FIG. 2.
Figure 6:
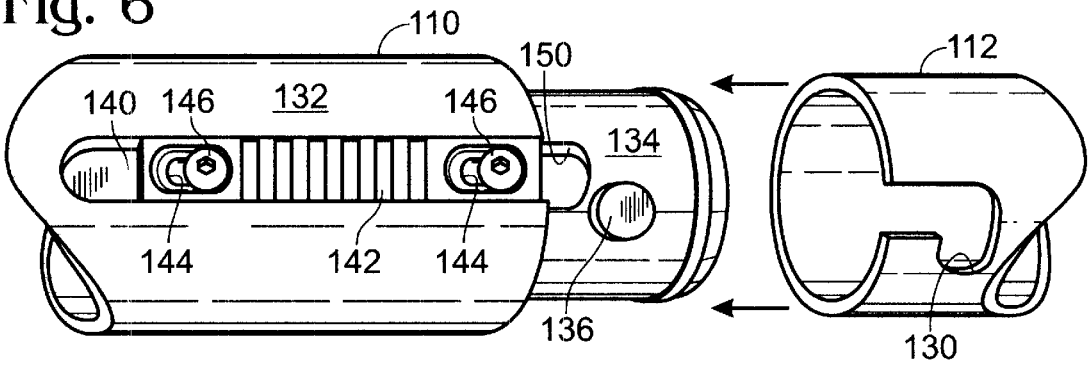
FIGS. 6–9 show sequential steps in the attachment of the penetrating nozzle of FIGS. 2–3 to a water line using a twist lock mechanism.

FIG. 5 shows an enlarged side elevation view of nozzle 112 to illustrate the continuation in the disposition of orifices 116 throughout the full circumference of nozzle 112. Also shown in FIG. 5 is an L-shaped slot 130 which cooperates with twist lock 110, as will now be described.

Figure 7:
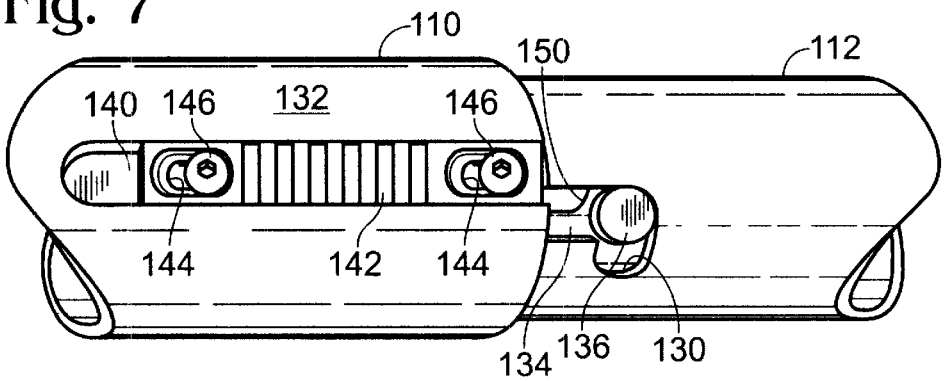
Figure 8:
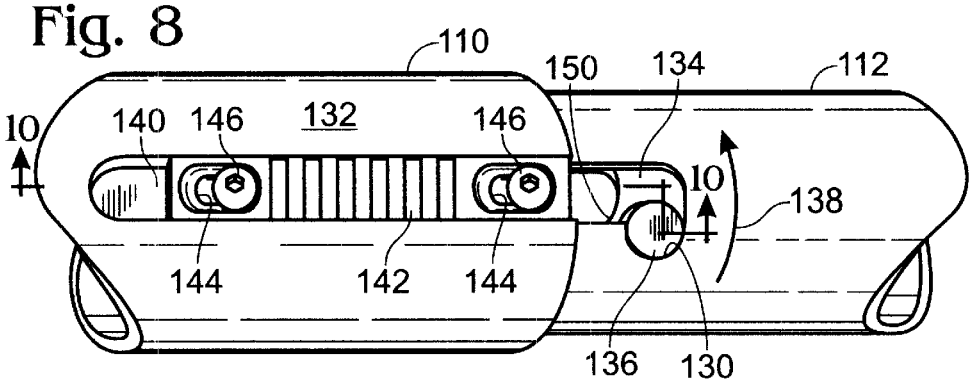
Figure 9:
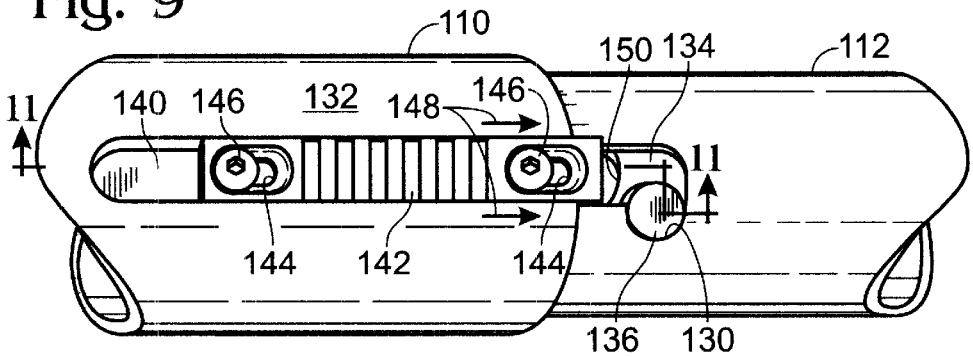

Four stages of operation of twist lock 110 are shown in FIGS. 6–9, relative to that end of nozzle 112 at which is disposed slot 130. Twist lock 110 principally comprises an outer cylinder 132 and an inner cylinder 134, and FIG. 8 shows nozzle 112 placed in parallel alignment with twist lock 110 such that slot 130 of nozzle 112 is placed in linear alignment with a nub 136 that extends outwardly from inner cylinder 134. The inner diameter of nozzle 112 is sized to be just larger than the outer diameter of inner cylinder 134 of twist lock 110 so that, as shown in FIG. 7, nozzle 112 can be slideably engaged with the outer surface of inner cylinder 134 such that nub 136 becomes disposed within the deepest inward recess of slot 130. As shown in FIGS. 8 and 9, full engagement of twist lock 110 with nozzle 112 is accomplished by rotation of nozzle 112 in the direction of arrow 138 of FIG. 9, which places nub 136 within the short "leg" or extension of slot 130 thereby preventing nozzle 112 from being pulled back out from engagement with inner cylinder 134.

To provide a locking mechanism as will be described shortly, twist lock 110 further comprises an elongate slide slot 140 disposed longitudinally along outer cylinder 134, a slide bar 142 of somewhat shorter length than slide slot 140 disposed within slide slot 140, two elongate but even shorter button slots 144 placed near to opposite ends of slide slot 140, and two slide buttons 146 that extend outwardly from inner cylinder 134 through button slots 144. As indicated by arrows 148, slide bar 142 slides longitudinally within both slide slot 140 and an inner elongate lock slot 150 that is disposed longitudinally along inner cylinder 134 to accomplish locking.

Figure 10:
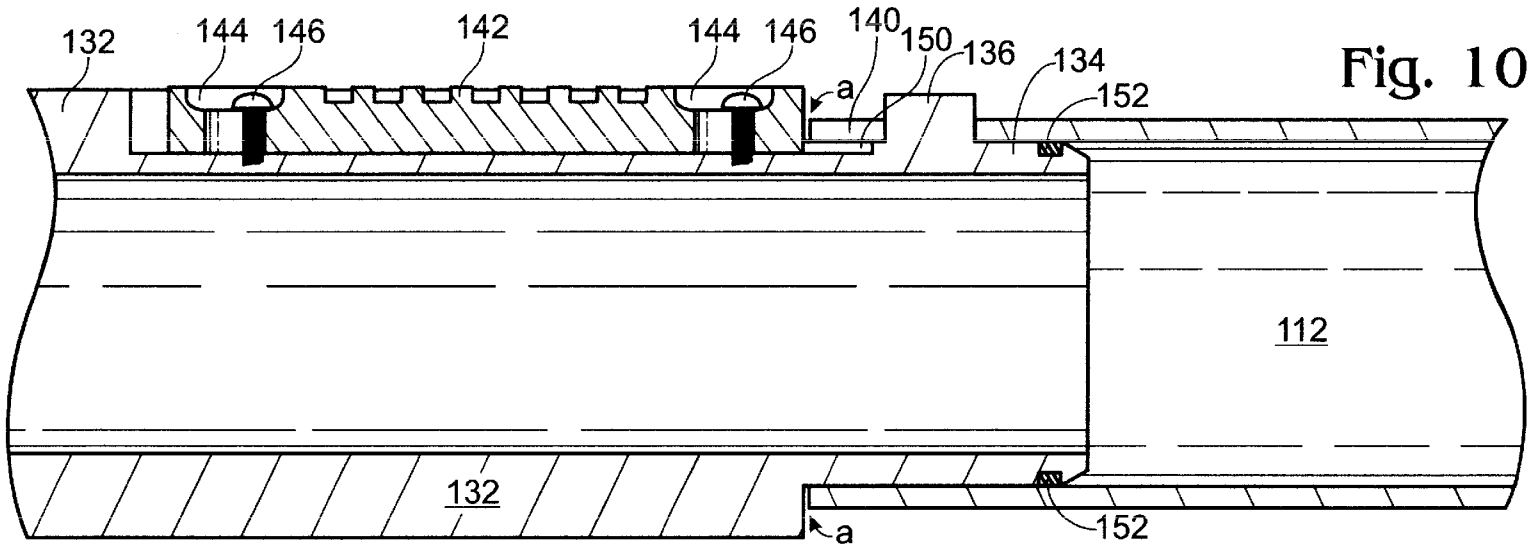
FIGS. 10 and 11 are longitudinal cutaway views of the twist lock of FIGS. 6–9 showing further detail of the locking mechanism.
Figure 11:
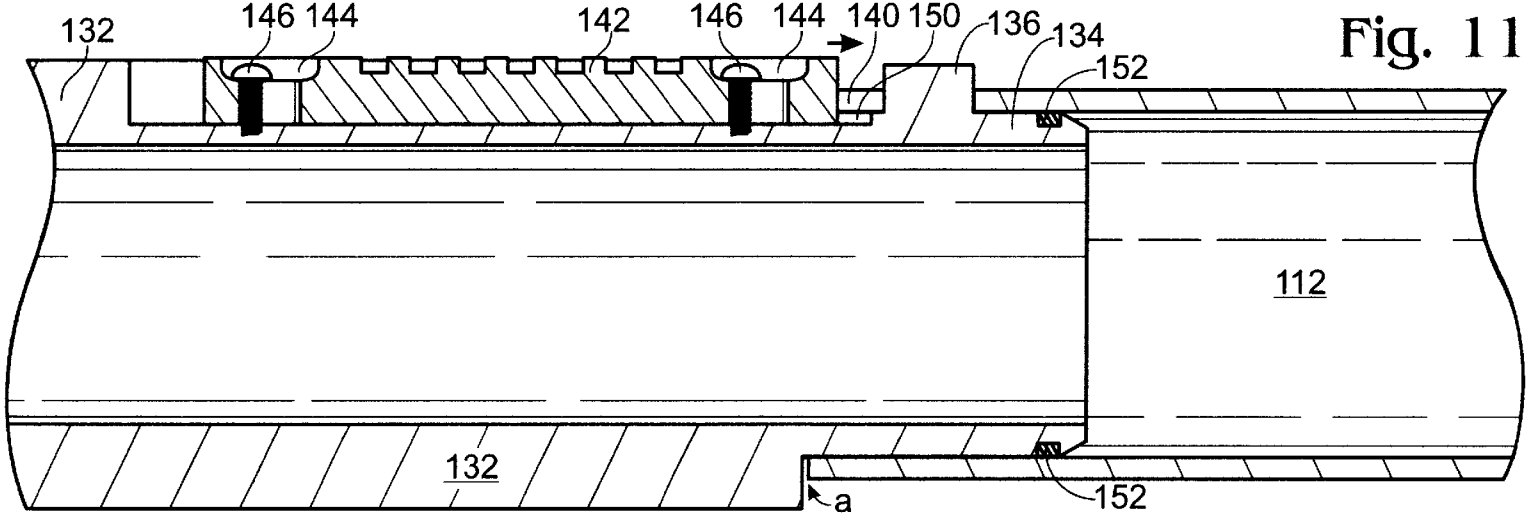

Locking is accomplished by preventing rotation of nozzle 112 relative to inner cylinder 134 in a direction opposite that shown by arrow 138 in FIG. 8. To illustrate that process, FIG. 10 is a longitudinal cross-sectional view of the combination of nozzle 112 and inner cylinder 134 in an "unlocked configuration, and FIG. 11 is a like view of that combination in a "locked" configuration, like elements relative to FIGS. 6–9 being indicated by like numbers in FIGS. 10–11. (FIGS. 10–11 further include cross-sectional views of a toroidal gasket 152 disposed near to the distal end of inner cylinder 134 which serves to provide a leak-proof interconnection between inner cylinder 134 and nozzle 112.)

What may first be noted in FIG. 10 is point "a" indicated at the upper center of the drawing, wherein the leftward terminus of nozzle 112 is seen not quite to reach the rightward terminus of slide bar 142. Similarly at the bottom of FIG. 10, another point "a" (coplanar with the upper point "a") is seen not quite to be reached by the leftward terminus of nozzle 112. By contrast, the rightward terminus of slide bar 142 in FIG. 11, wherein slide bar 142 has been moved in the direction of nozzle 112, obscures the previously visible leftward terminus of nozzle 112, the effect of which can also be seen in FIG. 9, wherein the right-ward end of slide bar 142 is seen unambiguously to have been inserted into the elongate part of slot 130, thereby preventing nozzle 112 from rotating relative to inner cylinder 134. It is evident that such rotation could occur, i.e., a nozzle 112 that had been connected to inner cylinder 134 could be disconnected therefrom, merely by drawing slide bar 142 back to the left and then rotating nozzle 112 in a direction opposite that of arrow 138 in FIG. 8 (so as to place nub 136 within the elongate part of slot 130) and then withdrawing nozzle 112 from inner cylinder 134.

Figure 12:
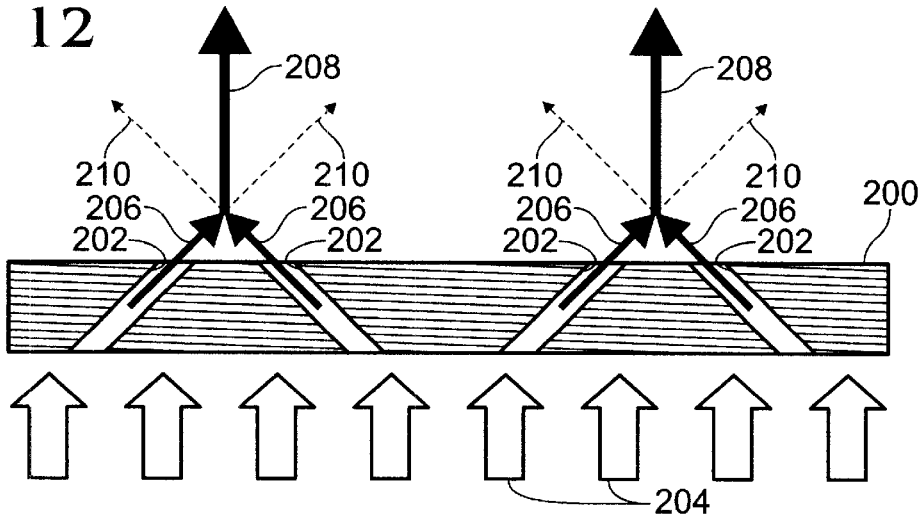
FIG. 12 depicts the physical processes occurring when individual ones of each of two pairs of fluid orifices are oriented at respectively opposite 45 degree angles, and thus at a mutual 90 degree angle one to the other, and are made to discharge a fluid.

FIG. 12 shows in vector notation the process of impinging streams of fluid one upon another, and in relation to two pairs of such streams of fluid linearly displaced one pair from the other. Elongate shaded region 200 of FIG. 12 may be taken to simulate a cross-section of fluid outlet 114 (although for purposes of clarity not including V-cut grooves 118); orifices 202 of FIG. 12 may be taken to represent corollaries to orifices 116 as previously described; and outline arrows 204 may be taken to represent sources of fluid pressure that will cause the discharge of fluid (upwardly in FIG. 12) through orifices 202. Vectors 206 in each case represent the initial direction of fluid discharge with respect to each of orifices 202, which lie at oppositely generated angles of 45 degrees to the long direction of shaded region 200.

The larger arrows 208 are resultant vectors that in each case are added from respective vectors 206, i.e., the principal result of impinging two streams of fluid on one another at a mutual angle of 90 degrees, in the manner described by Mitchell, is the production of a single stream at an angle of 135 degrees relative to the original streams, that resultant vector symmetrically bisecting the intersection of the two original vectors. Dotted "continuation" vectors 210 represent the secondary effect of impinging such streams of fluid one upon the other, i.e., because of scattering some portion of the fluid will continue on the original path of vectors 206, and indeed some portion of fluid will be discharged at all angles lying between the angles of vectors 208 and 210. Inasmuch as the two pairs of orifices have the same structure, the two resultant arrows 208 are seen to be mutually parallel and, given the initial vector angles of 45 degrees, lie at right angles to the long direction of shaded region 200.

Figure 13:
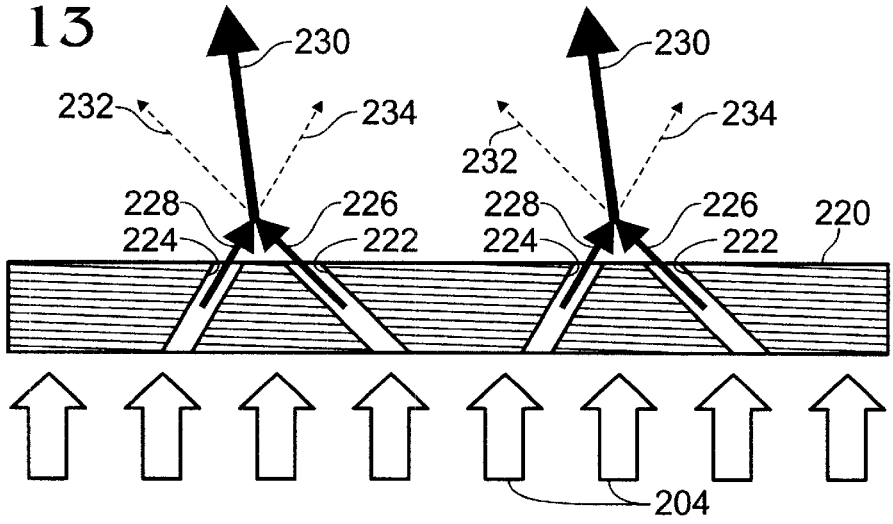
FIG. 13 depicts the physical processes occurring when individual ones of pairs of two pairs of fluid orifices are oriented at respective angles of 55 degrees and 45 degrees, each pair being a linear replica of the other, and are made to discharge a fluid.

FIG. 13 shows a similar structure, commencing with a shaded region 220 within which are disposed similar pairs of orifices except that within each pair the rightward orifices 222 again lie at angles of 45 degrees relative to the long direction of shaded region 220 while the leftward orifices 224 within each pair are disposed at corresponding angles of 55 degrees as measured from the horizontal (i.e., 35 degrees measured from the vertical). Respective fluid stream vectors 226 and 228 thus lie at those respective same angles relative to the long direction of shaded region 220.

The resultant vectors 230 that derive from the addition of vectors 226 and 228, while being mutually parallel as in the case of resultant vectors 208, are thus oriented not at 90 degrees from the long direction of shaded region 220 but rather at a smaller angle (skewed to the left in FIG. 13) thereto. Similarly, while the leftward dotted continuation vectors 232 lie at 45 degrees as did vectors 210, the rightward dotted continuation vectors 234 are skewed leftward, hence the consequence of that structure is that upon combination of both streams of fluid, the mist produced by combination of vectors 230 and all other vectors out to and including vectors 232 will lie at a small angle relative to the normal from shaded region 220. As a result, if as in FIGS. 2–3 and FIGS. 5–11 the operator of the device is taken to be located to the left in each of such figures, the mist produced by a nozzle so constructed will be directed somewhat towards the location of that operator, rather than being discharged essentially at right angles to the nozzle being used. A second effect is that since the angle between continuation vectors 232 and 234 is now 80 degrees rather than the 90 degree angle between respective vectors 210 of FIG. 12, the breadth of a mist pattern produced by any one pair of orifices will be narrower in the structure of FIG. 13 than it was in the structure of FIG. 12. It is of course evident that by reversing the disposition of angles as now shown in FIG. 13, such that the orifices to the right of each pair were given the angle of 55 degrees relative to the nozzle and those on left an angle of 45 degrees, the resultant mist would be discharged in a direction somewhat "forward," i.e., away from the operator.

Figure 14:
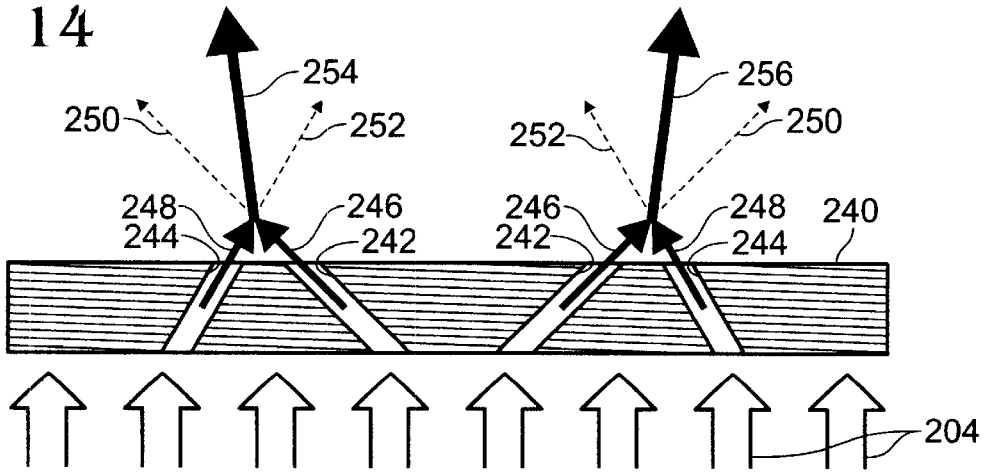
FIG. 14 depicts the physical processes occurring when individual ones of pairs of two pairs of fluid orifices are oriented at respective angles of 55 degrees and 45 degrees, those pairs being mirror images of one another and with the orifices that are oriented at 45 degrees being disposed on the outer sides of the pair combination, and are made to discharge a fluid.

FIG. 14 now shows that by judicious selection of orifice angles, it is possible by a second means to affect the shape of a mist ejected from a nozzle. That is, within shaded region 240 of FIG. 14, pairs of orifices are disposed such that in each case, the orifices 242 within each pair that are mutually facing as between pairs are disposed at angles of 45 degrees relative to the horizontal, while the single remaining orifice 244 within each pair is disposed at corresponding angles of 55 degrees. Two pairs of orifices constructed as in FIG. 14 will yield mist patterns that are skewed in opposite directions, so that the mist pattern arising from that combination of pairs will be made broader.

Thus, "inner" vectors 246 of FIG. 14 lie at angles of 45 degrees relative to the horizontal while the "outer" vectors 248 lie at corresponding angles of 55 degrees; corresponding continuation vectors 250 deriving from inner vectors 246 become "outer" vectors again lying at 45 degrees while continuation vectors 252 deriving from outer vectors 248 become "inner" vectors lying at 55 degrees, and since the dispositions of the orifice angles are opposite as between the two pairs, resultant vectors 254 and 256 deriving respectively from the leftward and rightward pairs of orifices in FIG. 14 are skewed in opposite directions—as it happens in this case away from each other so as to broaden the mist pattern derived from the two pairs of orifices taken together. It is of course evident that were the angles of the orifices within each pair shown in FIG. 14 exchanged, the result would be that the two resultant vectors would be skewed in the direction of rather than away from each other and the overall mist pattern arising from the two pairs of orifices would be narrowed.

It is also evident that the particular angles that may be selected are not limited to those set out in this illustration, in that the effects just described may be amplified substantially by selecting orifice angles relative to the horizontal ranging from near to zero to near to 90 degrees, and then combining the same in other variations of the manner described, so as to produce substantially more dramatic effects on both the direction and breadths of the mist patterns to be produced, as may be appropriate in fighting different kinds and dispositions of fires. In emphasizing the importance of having the two streams impact at 90 degrees on the theory that such a procedure maximizes the degree of formation of mist, Mitchell overlooks these possibilities of "tailoring" the nature of the mist emission to the nature of the fire and other circumstances.

Figure 15:
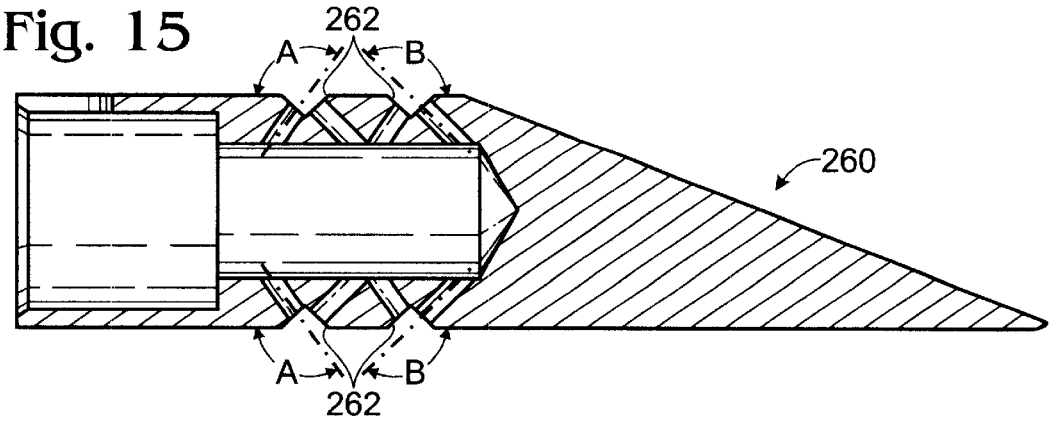
FIGS. 15–18 show different embodiments of the nozzle comprising the invention that illustrate the physical principles indicated in FIGS. 12–14, wherein orifices are established at different sets of predetermined angles within alternative native nozzle types that respectively include V-shaped groove and indentations or pits to aid in directing fluid flow.
Figure 16:
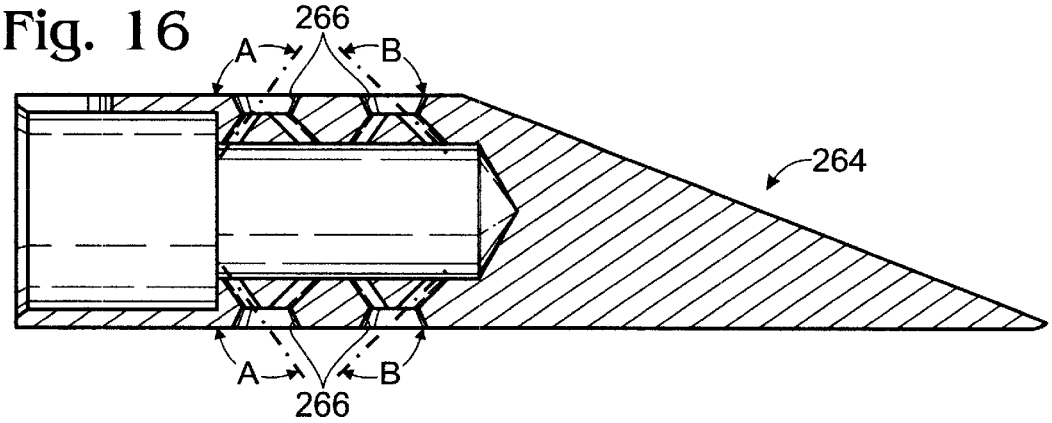

FIGS. 15–18 are longitudinal cross-sectional drawings of different embodiments of the fire nozzle of the invention wherein orifice angles (measured from the horizontal in each case) have been selected in combination with either V-shaped grooves or surrounding elliptical indentations (or "pits"). FIG. 15, for example, employs angles A-B-A-B for the two pairs of orifices, reading left to right, wherein A=55 degrees from the horizontal and A=45 degrees from the horizontal just as shown in FIG. 13, but in the context of a nozzle 260 that includes toroidal V-cut grooves 262 similar to grooves 118 of FIGS. 3 and 5. FIG. 16 then shows a similar nozzle 264 that employs the same orifice angles as does the device of FIG. 15, but wherein those orifices are disposed not within V-shaped grooves but rather within elliptical pits 266. The purpose of either grooves 262 or pits 266 is to help direct the outward flow of fluid. The purpose of using pits 266 rather than fully encircling grooves 262 is to minimize weakening of the nozzle structure at those points, given that the nozzle as a whole is ultimately to be pounded through a roof.

Figure 17:
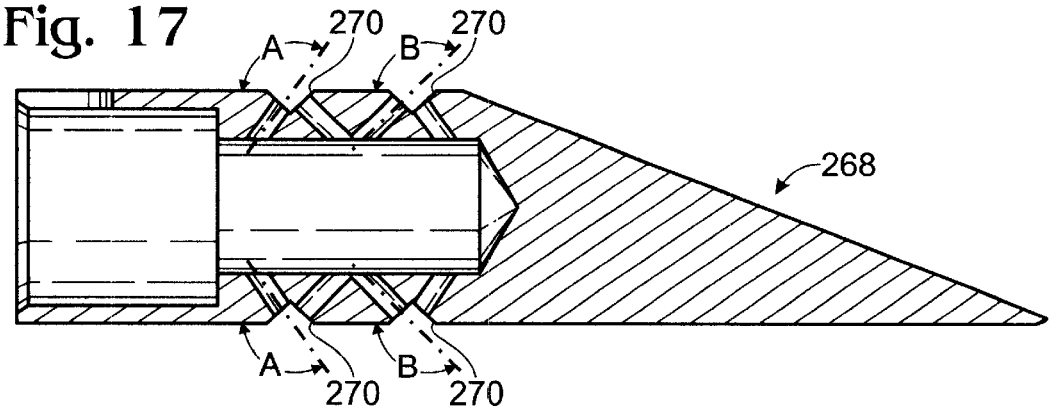
Figure 18:
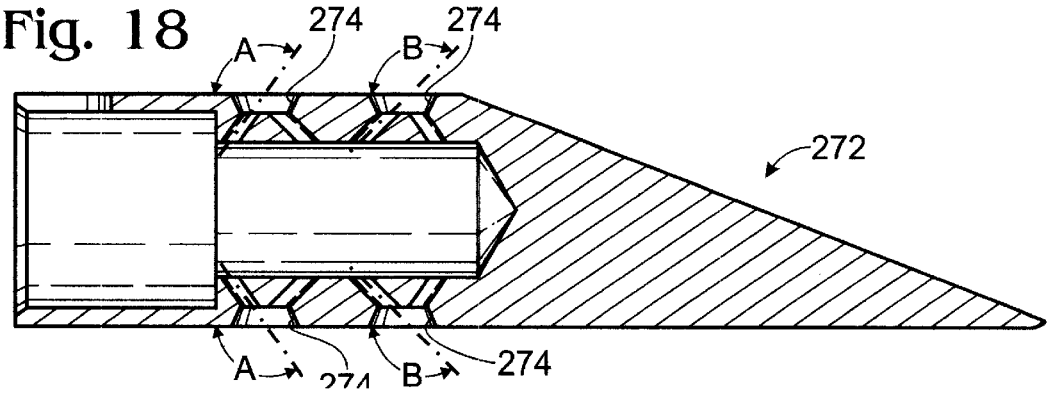

Similarly, FIG. 17 shows a nozzle 268 wherein a pattern A-B-B-A is employed in which again A=55 degrees and B=45 degrees, i.e., replicating the pattern shown in FIG. 14. Nozzle 268 incorporates V-shaped grooves 270, while FIG. 18 shows a nozzle 272 having the same pattern of orifice angles as does nozzle 268 but instead uses pits 274. It is thus evident that the full variation in orifice angles as was described with reference to FIGS. 12–14 can be applied in the context of nozzles having either V-shaped grooves or pits as aids in directing the fluid discharge.

FIG. 19 shows an oblique view of a nozzle comprising an embodiment of the invention wherein parallel rows of orifice pairs disposed within pits are interleaved with respect to their transverse displacement around the nozzle circumference. Specifically, nozzle 280, which includes bevel 282 at one end and L-shaped slot 284 at the opposite end for connection to a snap lock (not shown), has disposed therebetween mutually parallel toroidal rows 286 and 288 of orifices 290 placed within pits 292 wherein lines 294 that pass centrally and longitudinally through orifices 290 within a first one of rows 286, 288 pass essentially equidistantly between similar lines 294 that pass correspondingly through orifices 290 within the second one of rows 286, 288. The effect of such interleaving is to render the mist pattern resulting from both rows of aperture pairs more dense and concentrated than would be the case in which, as was previously described, pairs of apertures within different rows in the nozzle are longitudinally colinear.

FIG. 20 illustrates in a formal manner, without intending to depict precise angles or mist patterns, one advantage of using an embodiment of the nozzle comprising the invention wherein the mist pattern produced is to some extent directed back towards the user. That is, nozzle 300 is shown by solid lines in a first position wherein fluid outlet 302 has just passed through roof 304 (shown in outline). Mist pattern 306 is dispersed at an angle tending back towards the user (and hence towards the under side of roof 304 under the circumstances) and mist pattern 308 is discharged essentially at right angles to nozzle 300. The disposition of mist pattern 306 has the advantage, when the precise location of a fire on that side of roof 304 into which nozzle is to penetrate is not known, of commencing to extinguish any fire right at the point of entry through the roof.

That is, fire may often exist on the underside of a roof at precisely the point wherein entry is to be made—a circumstance which presents maximum danger to the fireman since the roof may collapse as a result of such fire, or hot gases may be emitted explosively therefrom—and mist pattern 306 can be seen to be dispensing mist initially within that immediate region. As indicated in the second position of nozzle 300 shown in outline, as nozzle 300 is forced progressively further through roof 304, the region encompassed by mist pattern 306 will widen outwardly from the point of entry, thus to expand a "fire-free" region and thereby decrease the danger to the firemen and allow much safer attack on the remaining fire underneath roof 304. Mist pattern 308 would seemingly function in the same manner as does mist pattern 306, were it not that the underside of roof 304 will have incorporated therein various beams and joists and the like as obstructions to a mist pattern proceeding in parallel to roof 304, hence discharge of mist into regions therebetween requires a flow of fluid "backwards" into such regions, i.e., as does mist pattern 306.

Figure 21:
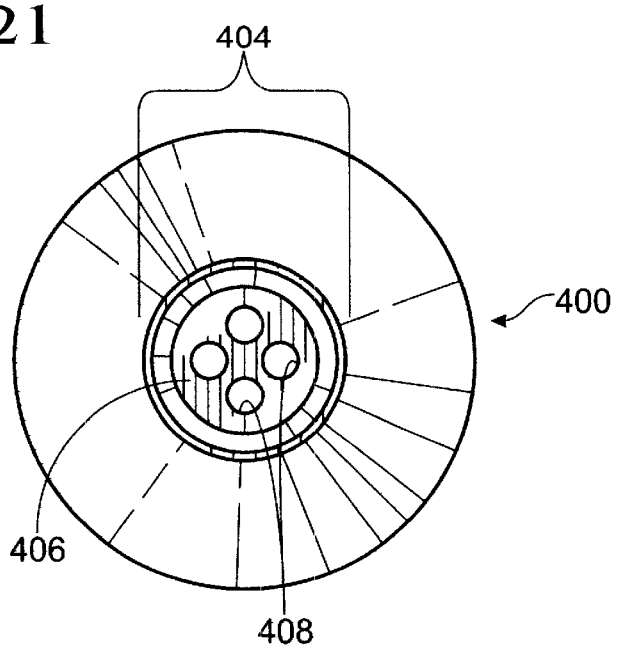
FIG. 21 is a front elevation view of an end discharge embodiment of the nozzle comprising the invention, including orifices for forward discharge of fluid.
Figure 22:
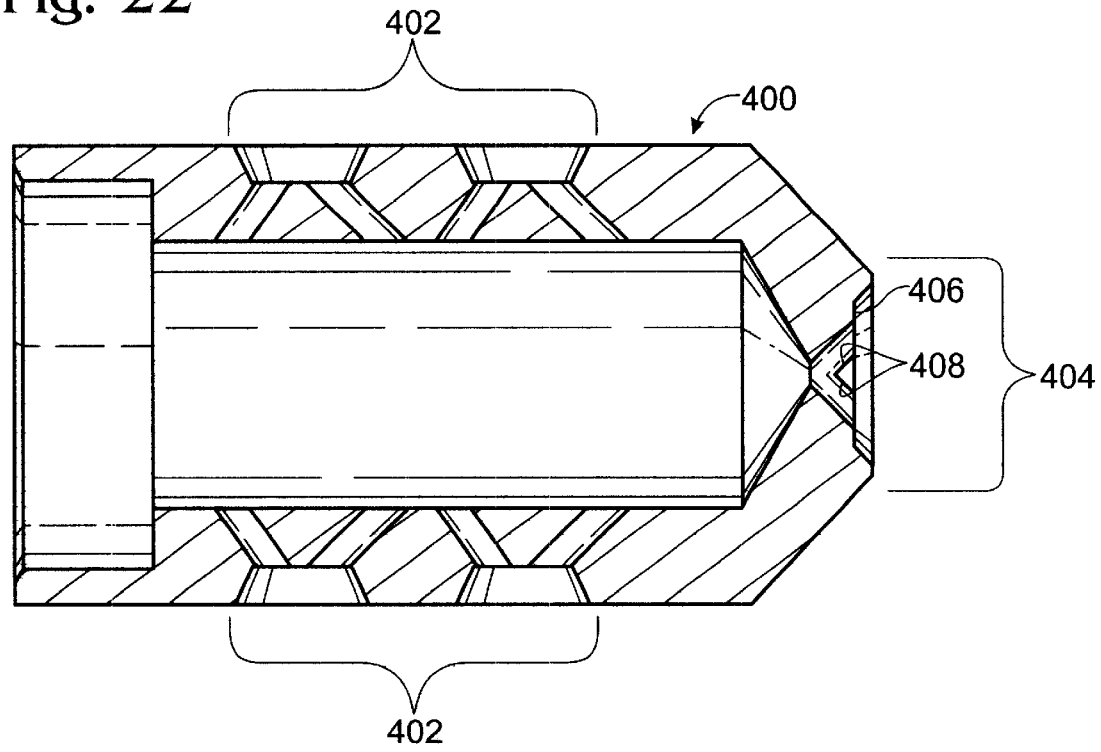
FIG. 22 is a longitudinal cutaway view of the end discharge nozzle of FIG. 21.

FIGS. 21 and 22 are respectively front elevation and longitudinal cutaway views of an end discharge embodiment of the nozzle comprising the invention, wherein provision is made for discharge of fluid in a forward direction in addition to the discharge of the fluid at some pre-selected set of angles transverse to the nozzle. Nozzle 400 is thus seen to comprise firstly a fluid outlet 402 that accomplishes transverse misting as previously described, and secondly an end discharge region 404 comprising a tetrahedral pit 406 within which are disposed discharge orifices 408 set at angles of 45 degrees to the long axis of nozzle 400, whereby opposing pairs of orifices 408 are at an angle of 90 degrees one to the other so as to accomplish forward misting. Since nozzle 400 is not a penetrating nozzle, a penetrating nozzle of one of the types previously described will first be used to achieve penetration of a roof; that nozzle will then be pulled out of the roof and after cutting off fluid flow will be replaced with nozzle 400. Nozzle 400 will then be inserted through the hole in the roof formed using the penetrating nozzle, and fluid flow will be resumed. Nozzle 400 is particularly applicable when it is noted that significant fire is located directly opposite the point of penetration through the roof.

Figure 23:
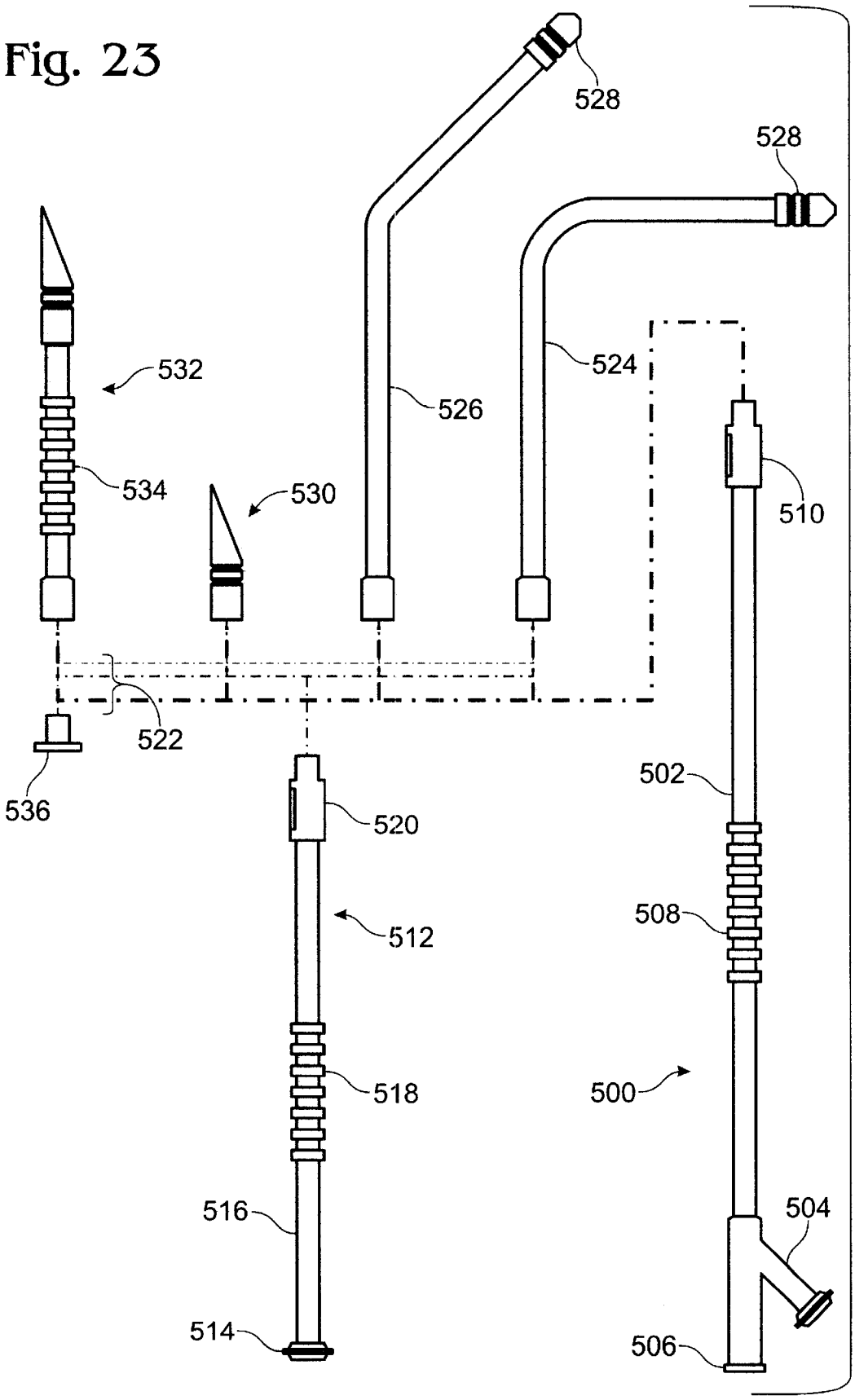
FIG. 23 is a top plan view of an array of wands that are removably attachable to various embodiments of the portion of the fire-fighting tool that includes the twist lock.

As now shown in FIGS. 21 and 22, nozzle 400 is but one example of a principal feature of the invention, namely, that in view of the twist lock aspect thereof, various fluid discharge implements may easily be interchanged and used as appropriate to particular fire circumstances. Thus, fire tool 500 in FIG. 23 is an elongate version of fire tool 100 shown in FIG. 2 but not including the attached nozzle there shown. Fire tool 500 includes along its hollow cylindrical form 502 a fluid inlet 504, a strike plate 506, a hand grip 508, and a twist lock 510 in the manner of fire tool 100. Fire tool 512 is a shortened version of fire tool 500 to be used when a roof has already been penetrated so no strike plate is needed, and hence fluid inlet 514 may be placed in-line with cylinder 516 and its associated hand grip 518 and twist lock 520.

Dotted lines 522 are intended to indicate that any of the devices shown above lines 522 in FIG. 23 may be connected to any of the devices below those lines for various purposes. As a practical matter, fires may occur inside of closets, under stair wells or eaves, and various other places within either a building or a boat or motor vehicle or the like, and the implements of FIG. 23 are meant to provide the firefighter with the tools necessary to gain access to fires in any of such locations. Wands 524 and 526 which terminate in end discharge nozzles 528 similar to nozzle 400 are thus bent respectively at angles of 90 degrees and 45 degrees, although other angles may at times be used instead. "Wand" 530 is simply a penetrating nozzle as has previously been described, and wand 532 is a lengthened penetrating nozzle having incorporated therein its own hand grip 534. Cap 536 serves simply to "cap off" any of the various wands when not in use.

Other arrangements and disposition of the aforesaid or like components, the descriptions of which are intended to be illustrative only and not limiting, may also be made without departing from the spirit and scope of the invention, which must be identified and determined only from the following claims and equivalents thereof.

I claim:

1. A fire-fighting tool for applying a fire-fighting fluid to a fire, comprising:

an elongate hollow tube;

fluid input means disposed near to a first end of said elongate hollow tube;

coupler receiving means disposed near to a second end of said elongate hollow tube, said coupler receiving means further comprising an inner cylinder extending coaxially from said elongate hollow tube, a nub extending transversely from said inner cylinder, and a manually slidable bar disposed longitudinally atop said elongate hollow tube near to said inner cylinder and having a first position towards said second end and a second position away from said second end; and a hollow coupler tube having a threaded first end and a slotted second end, said slotted second end being L-shaped and having a long leg and a short leg and being sized to engage both said nub and said slidable bar, said coupler tube further being removably attachable to said elongate hollow tube by sliding said coupler tube over said inner cylinder, aligning and engaging said long leg of said slotted second end with said nub, sliding said bar into said second position, rotating said coupler tube to align said bar with said long leg of said slotted second end and aligning said nub with said short leg of said slotted second end, and sliding said bar into said slotted second end in said first position, wherein said bar is disposed within said long leg of said slotted second end.

2. The tool of claim 11 further comprising a hand grip disposed on and along an outer surface of said elongate hollow tube, along a predetermined length thereof, and comprising a plurality of mutually parallel toroidal extensions, whereby a user of said tool gains assistance from said hand grip in manually grasping said hand grip for the purpose of thrusting said elongate hollow tube along the direction of the principal axis of said elongate how tube.

3. The tool of claim 11 further comprising ceramic coating disposed principally onto the surface of said elongate hollow tube near to said fluid input means.

4. The tool of claim 1 further comprising:

an elongate hollow nozzle tube having a first threaded end removably attached to said coupler tube; and a multiplicity of pairs of fluid output orifices directed outwardly from said hollow nozzle tube near a second end, wherein central major axes of said fluid output orifices constituting each of said pairs of fluid output orifices lie at angles relative to said nozzle tube so as to form an angle between said major axes that is other than 90 degrees, said angles of said major axes further defining a point of intersection of said major axes at a predetermined distance from said nozzle tube, whereby streams of fluid exiting respective fluid exit orifices that constitute each of said pairs of fluid output orifices will impinge one upon the other at said point of intersection, and whereby said streams of fluid exiting respective exit orifices form an outwardly propagating mist of water having predetermined angle of spread.

5. The tool of claim 4 wherein said central major axes of said fluid output orifices within said pairs of fluid output orifices lie at angles relative to said nozzle tube such that said point of intersection lies a predetermined distance away from said pairs of fluid output orifices in the direction towards said first end of said nozzle tube.

6. The tool of claim 4 wherein said central major axes of said fluid output orifices within said pairs of fluid output orifices lie at angles relative to said nozzle tube such that said point of intersection lies a predetermined distance away from said pairs of fluid output orifices in the direction away from said first end of said nozzle tube.

* * * * *